US006066248A

United States Patent [19]

Lyke et al.

[11] Patent Number: 6,066,248

[45] Date of Patent: May 23, 2000

[54] PROCESS FOR AQUEOUS HCL ELECTROLYSIS WITH THIN FILM ELECTRODES

[75] Inventors: Stephen Erwin Lyke, Wilmington; Pallav Tatapudi, Hockessin, both of Del.

[73] Assignee: E. I. du Pont de Nemours and Company, Wilmington, Del.

[21] Appl. No.: 09/179,703

[22] Filed: Oct. 27, 1998

[51] Int. Cl.[7] ..... C25B 1/26

[52] U.S. Cl. ..... 205/620; 205/637

[58] Field of Search ..... 205/620, 624, 205/625, 637

[56] References Cited

U.S. PATENT DOCUMENTS

| | | | |
|---|---|---|---|
| 4,287,032 | 9/1981 | Pellegri | 205/624 |
| 4,959,132 | 9/1990 | Fedkiw, Jr. | 205/624 |
| 5,789,036 | 8/1998 | Zimmerman et al. | 205/620 |

*Primary Examiner*—Kishor Mayekar

[57] ABSTRACT

A process for the electrolysis of aqueous hydrochloric acid solution in an electrochemical flow reactor comprising a solid polymer electrolyte membrane, an anode, a cathode and backings, wherein the anode is comprised of an electrocatalytic material and an ionomer is disclosed. The process provides high current density at low cell voltage, and low HCl outlet concentration while minimizing side reactions.

13 Claims, 2 Drawing Sheets

PROCESS FOR AQUEOUS HCL ELECTROLYSIS WITH THIN FILM ELECTRODES

BACKGROUND OF THE INVENTION

1. Field of the Invention

The present invention relates to a process for the electrolysis of hydrogen chloride in aqueous solution, and more particularly, to reducing cell voltage at a given current density or enhancing current density in an electrolytic cell having thin film electrodes.

2. Description of the Related Art

Aqueous hydrogen chloride (HCl) or hydrochloric acid is a reaction byproduct of many manufacturing processes that use chlorine. For example, chlorine is used to manufacture polyvinylchloride, isocyanates, and chlorinated hydrocarbons/fluorinated hydrocarbons, with hydrogen chloride as a byproduct of these processes.

Because supply so exceeds demand, byproduct hydrogen chloride or hydrochloric acid often cannot be sold or used, even after careful purification. Shipment over long distances is not economically feasible. Discharge of the acid or chloride ions into waste water streams is environmentally unsound. Recovery and feedback of the chlorine to the manufacturing process is the most desirable route for handling the HCl byproduct. A number of commercial processes have been developed to convert HCl into usable chlorine gas.

Currently, thermal catalytic oxidation processes exist for converting anhydrous HCl and aqueous HCl into chlorine. Commercial processes, known as the "Shell-Chlor", the "Kel-Chlor" and the "MT-Chlor" processes, are based on the Deacon reaction. This reaction was originally developed in the 1870's using a fluidized bed containing a copper chloride salt which acts as the catalyst. HCl reacts with oxygen to produce chlorine gas and water. Commercial improvements to the Deacon reaction have involved use of alternatives to the copper chloride catalyst; promoters to improve the rate of conversion and to reduce the energy input; and methods to reduce the corrosive effects on processing equipment by the harsh chemical reaction conditions. However, in general, thermal catalytic oxidation processes require complicated separations of the reaction components to achieve product purity. These processes also require expensive construction materials for the highly corrosive reaction systems, which operate at temperatures of 250° C. and above.

Electrochemical processes exist for converting aqueous HCl to chlorine gas by passage of direct electrical current through the solution. The current electrochemical commercial process is known as the "Uhde" process. In this process, aqueous HCl of about 22 wt % is fed at 65–80° C. to both compartments of an electrochemical cell, where exposure to a direct current in the cell results in an electrochemical reaction and a decrease in HCl concentration to 17 wt %, with the production of chlorine and hydrogen gases. A polymeric separator divides the two compartments. The process requires recycling of the dilute (17 wt %) HCl solution (generally by adsorbing gaseous, anhydrous HCl) to regenerate HCl solution of 22 wt % for feed to the cell. This means the process generally operates on anhydrous HCl feed even though the medium is aqueous. If HCl concentration becomes too low, a side reaction may occur whereby oxygen is generated from the water present in the system, which increases operating costs. Further, use of HCl as the supporting electrolyte in the Uhde system limits current densities at which the cells can perform to less than 500 amps/ft$^2$ (0.54 amps/cm$^2$). As HCl is converted to chlorine, the electrolyte becomes depleted of ions, increasing resistance to the flow of current and, potentially, causing side reactions to occur. Aqueous HCl that is present in the gap between the electrodes serves as both the electrolyte and the reactant for chlorine evolution. During the course of electrolysis, the $Cl_2$ and $H_2$ gases formed at the two electrodes cause a "blinding effect" by forming a gaseous film on the electrode surface, thereby further impeding the ionic pathway between the electrodes and the aqueous HCl. Use of an aqueous electrolyte coupled with a non-conductive polymeric membrane as a separator results in additional resistance and therefore reduces electrical efficiency of the system.

Controlling and minimizing oxygen evolution by the side reaction are important considerations in Balko, U.S. Pat. No. 4,311,568. Balko describes a process for aqueous HCl electrolysis which uses an electrolytic cell having a solid polymer electrolyte membrane. Evolution of oxygen decreases cell efficiency and leads to rapid corrosion of cell components. The design and configuration of the anode pore size and electrode thickness maximizes transport of the chloride ions. This results in effective chlorine evolution while minimizing the evolution of oxygen, since oxygen evolution tends to increase under conditions of chloride ion depletion near the anode surface. In Balko, although oxygen evolution may be minimized, it is not eliminated. As can be seen from FIGS. 3 to 5 of Balko, as the overall current density is increased, the rate of oxygen evolution increases, as evidenced by the increase in the concentration of oxygen found in the chlorine produced. Balko, can run at higher current densities, but is limited by the deleterious effects of oxygen evolution especially on carbon-containing electrodes. Further, while Balko teaches thinner anodes provide better performance, anodes having thickness less than 6 microns demonstrated unacceptable performance.

The electrochemical cell of Balko, U.S. Pat. No. 4,311,568, employs a membrane and electrodes that are physically separate elements, which have been bonded together using high pressure. Such an arrangement has non-uniformities in both the membrane and the electrodes, resulting in uneven contact therebetween and less utilization of the catalyst than if the contact between the membrane and the electrodes were uniform. Accordingly, the current density of such a cell is limited by catalyst utilization.

Faita, EPO 785 294 A1, describes a process for aqueous HCl electrolysis in an electrochemical cell, wherein the anode and cathode are separated by an ion exchange membrane and are constructed from titanium or titanium alloys, which are less costly than conventional graphite-based materials. The process is further characterized by addition of an oxidizing compound to the aqueous HCl solution, typically ferric ion, and feeding an oxygen-containing gas to the cathode to generate water, to maintain titanium in a passive condition. However, Faita teaches only low current densities of 3–4 kA/m$^2$, is limited to an oxygen reducing cathode and further, does not address low acid concentration and associated problems relating to generating oxygen at the anode.

Uehara, et al., in a series of articles (*Denki Kagaku oyobi Kogyo Butsuri Kagaku*, 1990, vol. 58, no. 4, pp. 360–7; *Denki Kagaku oyobi Butsuri Kagaku*, 1990, vol. 58, no. 5, pp. 459–65; *Denki Kagaku*, 1990, vol. 58, no. 11, pp. 1052–8; and *Osaka Kogyo Gijutsu Shikensho Kiho*, 1993, vol. 44, no. 2, pp. 47–52) disclose studies on aqueous HCl electrolysis using a solid polymer electrolyte membrane. Electrodes were prepared using chemical plating methods. Voltage characteristics were studied under conditions, wherein the anode and cathode HCl concentrations were equal. Current efficiency was studied in terms of hydrogen and chlorine yields, with and without an external supply to feed the cathode. Differences between having the electrocatalyst bonded and non-bonded to the membrane were also disclosed.

While processes for the electrolysis of aqueous solutions of HCl are known, it is still desirable to improve upon these processes to make them more attractive economically as a means to recycle byproduct hydrochloric acid solutions. It would be desirable to have a process for the electrolysis of aqueous HCl to generate chlorine having either separately, or in combination, improvements in current density, cell voltage and lower oxygen evolution, particularly at low HCl concentration. Current density is related to reaction rate. Higher current densities provide higher reaction rates, allowing for smaller reactors, and therefore lower investment. Cell voltage is related to energy requirements for the process. Lower cell voltage requires less energy and therefore lower operating costs. Lower oxygen evolution reduces current efficiency losses and corrosion of carbon-based cell components. Operating with a lower outlet HCl concentration allows higher per pass conversion of the HCl feed, especially when the HCl feed concentration is limited by the HCl-water azeotrope (ca. 20 wt % HCl). The present invention provides such a process for the electrolysis of aqueous solutions of HCl.

SUMMARY OF THE INVENTION

The present invention provides in a process for the electrolysis of an aqueous solution of hydrochloric acid in an electrochemical flow reactor comprising a solid polymer electrolyte membrane, an anode, and a cathode to produce chlorine, the improvement comprising feeding the hydrochloric acid solution to an anode comprising an electrocatalytic material and ionomer. To form the reactor, the anode is placed on one side of the membrane and the cathode is placed on the other side of the membrane; the anode and cathode each having a backing. In one embodiment, the anode is deposited directly on the solid polymer membrane. In an alternative embodiment, the anode is deposited directly on its backing. The design of the cathode is not critical for this invention. The cathode can be of the same design as the anode within the electrochemical flow reactor or of a different design.

Optionally, oxygen or a reducible metal ion can be fed to the cathode to lower the operating cell voltage. This results in lower power consumption and therefore lower operating costs. The metal can be selected from the group comprising iron (III), copper (II), cerium (IV), cobalt (III), gold (III), and silver (II).

The process of this invention is characterized by high current densities and low cell voltages, while minimizing oxygen generation. In the process of this invention, it is particularly advantageous when the anode has a thickness of less than 6 microns, preferably less than 3 microns. Surprisingly, it has been found that in the process of this invention, unreacted aqueous HCl exiting the flow reactor, i.e., outlet HCl, can be as low as 15 wt % HCl or less. As a result, the outlet HCl can be recycled to an absorber, which may be limited to producing a maximum HCl concentration of only 19 wt % HCl, thereby providing a process that does not require anhydrous HCl feed. High conversions can be achieved such that the outlet HCl concentration can be as low as 10%, with very low oxygen concentration in the chlorine product.

DETAILED DESCRIPTION OF THE INVENTION

Reactor

Figure 1:
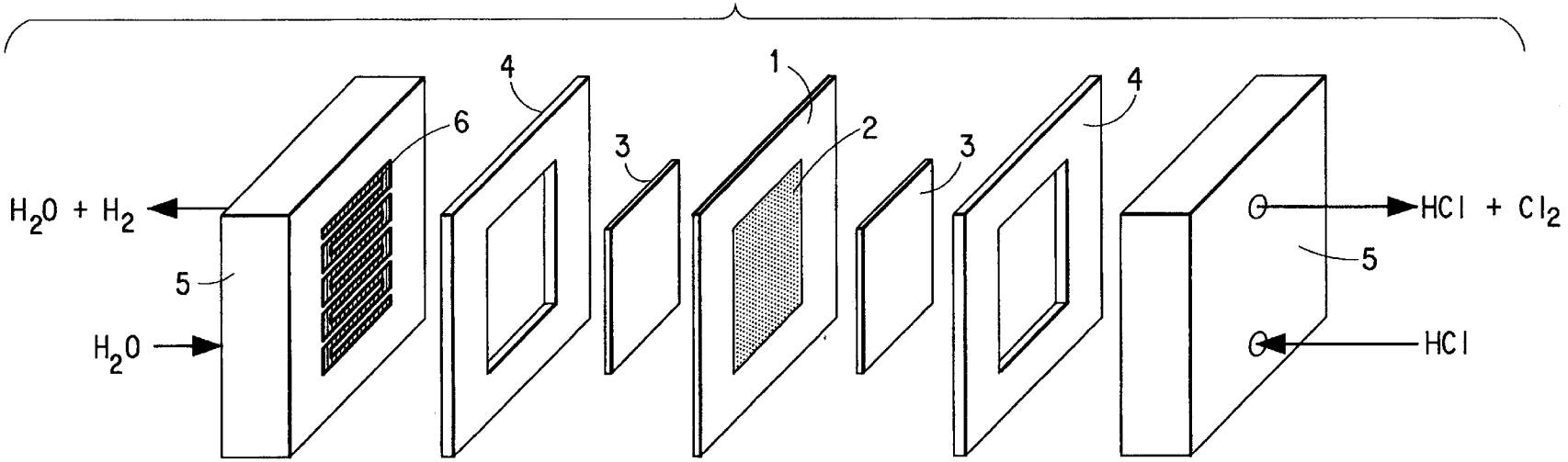
FIG. 1 shows an exploded view of an electrochemical flow reactor useful in the process of this invention, wherein the anode and cathode are deposited directly on the solid polymer membrane.

The present invention provides a process for the electrolysis of aqueous solutions of hydrochloric acid to produce chlorine in an electrochemical flow reactor. The reactor is comprised of a solid polymer electrolyte membrane, an anode, a cathode and backings. The anode is located on one side of the membrane and the cathode is placed on the other side of the membrane. The anode and cathode each have a backing. The membrane, anode, cathode and backings are sandwiched between two conductive plates to form the reactor. The reactants and products diffuse through the backings and react at the membrane-electrode interface of the reactor. Multiple cells can be stacked or arranged in series per conventional electrolyzer design.

The solid polymer electrolyte membrane can be any suitable membrane, and is generally a fluorinated ion exchange membrane of the cationic type, more specifically, a proton conducting membrane. The membrane is typically a commercial cationic membrane made of a fluoro or perfluoropolymer, preferably a copolymer of two or more fluoro or perfluoromonomers, at least one of which has pendant sulfonic acid groups. Suitable membranes are available from E. I. du Pont de Nemours and Company, Wilmington, Del., under the trademark "NAFION", hereinafter referred to as NAFION®. In particular, NAFION® membranes containing pendant sulfonic acid groups include NAFION® 117, NAFION® 324, NAFION® 417, and NAFION® 115. Other membranes that can be used include those produced by radiation grafting or other techniques. Still other suitable membranes are described by Artysiewicz, et al. in pending U.S. patent application, application Ser. No. 08/671867, filed Jun. 28, 1996, now U.S. Pat. No. 5,798,036 PCT publication no. WO 98/00581, published Jan. 8, 1998.

The backings are electrically conductive and macroporous materials, and can be for example, carbon or a suitably corrosion resistant metal mesh such as one comprising titanium. A backing functions as a current distributor, diffuser and flexible spacer.

The conductive plates can be for example, graphite blocks or titanium plates. Gaskets made of Teflon® or other non-conductive material, with openings cut out for the anode and cathode backings, will typically be placed between the conductive plates and the membrane to insulate each plate from the membrane.

Intervening flow channels may be incorporated into the conductive plates for gas/liquid distribution. Multiple, parallel flow channels, which may be either straight or serpentine, may be used. Smaller cells may use a single, serpentine channel in each plate. In the case of multiple, parallel channels, manifolds distributing and collecting flow to and from the channels must be designed to promote even flow distribution between the channels. The flow channels may be machined into the plates or provided by other means known to those skilled in the art. The conductive plates are in electrical contact with the electrodes, i.e., the anode and the cathode, through the backings. The conductive plates also serve to direct flow of the hydrochloric acid solution to the anode and to direct unreacted, outlet HCl solution and chlorine to exit the reactor.

Electrodes

The electrodes, both anode and cathode are porous thin film layers comprising an electrocatalytic material and an ionomer. In one particular embodiment, the anode is prepared by depositing the electrocatalytic material directly on the solid polymer membrane.

The electrocatalytic material may comprise any type of catalytic or metallic material or metallic oxide, as long as the material can support charge transfer. Preferably, the electrocatalytic material may comprise a catalyst material such as platinum, ruthenium, osmium, rhenium, rhodium, iridium, palladium, gold, titanium or zirconium and the oxides, alloys or mixtures thereof Alternative electrocatalytic materials include tin oxide, cobalt oxide, perovskites, pyrochlors, spinels, metal porphyrins and high surface area carbons.

The loading of electrocatalytic material in the electrode deposited on the ion exchange membrane may vary. Typically loadings are 0.01 to 4 mg/cm$^2$. The weight ratio of electrocatalytic material to ionomer in the electrode may vary from 2:1 to 6:1, with a ratio of 6:1 providing the lowest thickness.

The ionomer can be, for example, a fluoropolymer or perfluoropolymer having pendant sulfonic acid groups. Suitable ionomers are available from E. I. du Pont de Nemours and Company, under the trademark "NAFION". These ionomers can be the same or different from the materials used as the solid polymer electrolyte membrane. Preferably the ionomer is NAFION® of varying equivalent weights, more preferably, NAFION® having equivalent weights in the range 900–1300. The use of an ionomer in the electrode composition is critical to achieve good ionic conductivity in the electrode, which allows for use of thinner electrodes. Further benefits realized with use of an ionomer in the electrode composition include the ability to use lower HCl concentrations without increasing the oxygen concentration in the chlorine and the ability to operate at lower HCl outlet concentrations.

The anode may be prepared by depositing the electrocatalytic material onto the solid polymer membrane. This process involves mixing the electrocatalytic material with a solubilized (liquid) solution of an ionomer and spreading the mixture on the surface of the membrane to form a coating. Solvents for the process can be various suitable resin materials that are available commercially or can be made according to the patent literature. The coating containing the electrocatalytic material is typically bonded, or fixed, to the surface of the membrane by pressure, heat or preferably, a combination of pressure and heat. Examples of processes that can be used to prepare the electrodes are described in greater detail by Wilson and Gottesfeld in *J. Electrochem. Soc.* Vol. 139, No. 2, 1992, pp. L28–L30 and by Artysiewicz, et al. in aforementioned pending U.S. patent application, application No. 08/671867, the teachings of which are incorporated herein by reference.

The cathode can be prepared in the same manner, depositing electrocatalytic material on the other side of the solid polymer membrane, opposite the anode. When both the anode and cathode are prepared in this manner, a membrane electrode assembly (MEA) is formed.

In an alternative embodiment, the anode is prepared by depositing the electrocatalytic material directly on the backing rather than on the solid polymer membrane. The electrocatalytic material and ionomer are the same as described above. There are certain advantages of this embodiment relative to depositing the electrocatalytic material on the membrane which include, ease of fabrication, e.g., eliminating the step of bonding the coating to the membrane by heat and/or pressure, and lower hydrogen cross-over values. By hydrogen cross-over, it is meant hydrogen that may be found in the chlorine gas product. When the anode is deposited on a backing, reduced hydrogen in the chlorine product has been found.

A process to deposit the electrocatalytic material on a backing involves a similar process to depositing the material on the solid polymer membrane. That is, a solution of an ionomer is mixed with the electrocatalytic material; the mixture is then spread onto the surface of a backing. The cathode can be prepared in the same manner, by depositing electrocatalytic material on a second backing. In an electrochemical flow reactor, wherein the anode and cathode are deposited on the backings, the solid polymer membrane is placed between the anode and the cathode, and this membrane is then placed between two conductive plates.

The cathode can be of the same design as the anode within the electrochemical flow reactor or of a different design. The cathode may be deposited directly on the solid polymer membrane or directly on a backing, when incorporated into a reactor having a similarly designed anode. Alternatively, the cathode may be deposited on a backing while the anode is deposited on the solid polymer membrane, and vice versa. Still other forms of the cathode can be contemplated.

DETAILED DESCRIPTION OF THE FIGURES

FIG. 1 shows the elements of an electrochemical flow reactor useful in the process of this invention. A solid polymer electrolyte membrane 1 divides the anode side of the reactor from the cathode side. The anode 2 is directly deposited on membrane 1. The cathode cannot be seen from the view shown as it is deposited on the opposite side of membrane 1. Carbon cloth backings 3 are placed against the anode and the cathode opposite membrane 1. Teflon® gaskets 4 are placed between the graphite blocks 5 and membrane 1. Each gasket 4 has the center area cut out for backings 3. One of the graphite blocks 5 shows channels 6 for gas/liquid distribution.

The arrows show direction of flow of materials in and out of the reactor. Aqueous HCl enters the reactor at the anode side through graphite block 5. At the anode the HCl is converted to $Cl_2$. The $Cl_2$ and unreacted aqueous HCl exit the anode side of the reactor. Water is fed to the cathode side of the reactor through graphite block 5. Protons from the anode side of the reactor pass through membrane 1 to the cathode where they react and form $H_2$. $H_2$ and water exit the cathode side of the reactor.

Figure 2:
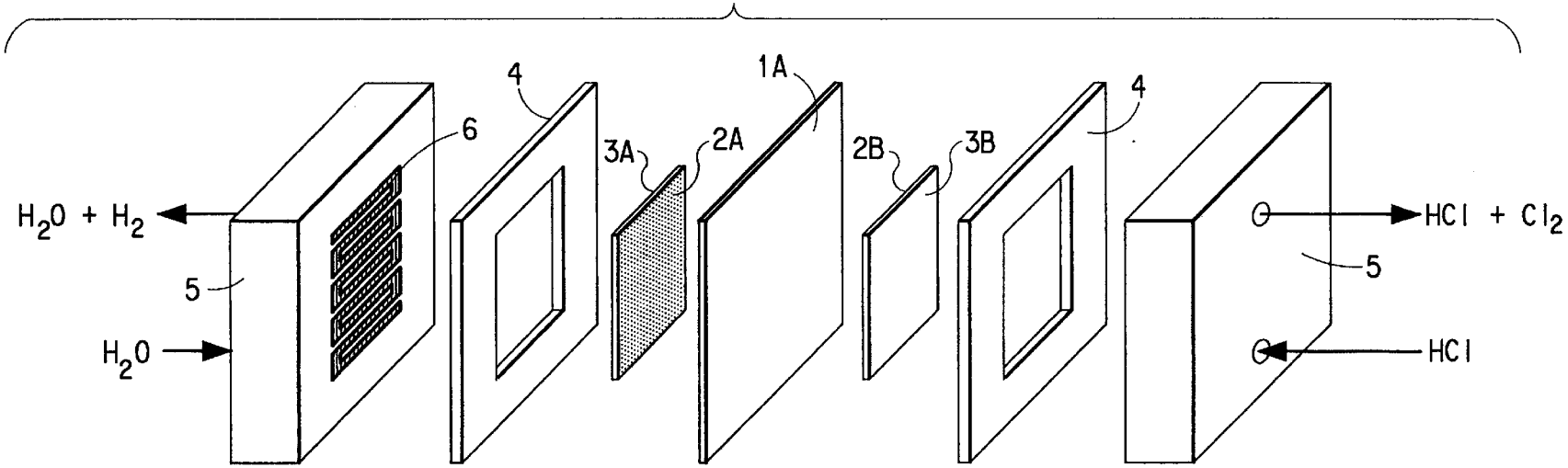
FIG. 2 shows an exploded view of an electrochemical flow reactor useful in the process of this invention, wherein the anode and cathode are deposited directly on carbon backings.

FIG. 2 shows the elements of an alternative electrochemical flow reactor useful in the process of this invention. Identical numbers refer back to the same features in FIG. 1. A solid polymer membrane 1A divides the reactor into an anode side and a cathode side. The cathode 2A is deposited on backing 3A, which is not seen in the view shown. Anode 2B cannot be seen from the view shown and is deposited on backing 3B. The flows in FIG. 2 are the same as flows in FIG. 1.

Process

The present invention provides a process for the production of chlorine by electrolysis of an aqueous solution of hydrochloric acid (eqs. 1–3). The concentration of HCl in the feed $$\text{Anode} \quad 2Cl^- \longrightarrow Cl_2\uparrow + 2e^- \tag{1}$$

$$\text{Cathode} \quad 2H^+ + 2e^- \longrightarrow H_2\uparrow \tag{2}$$

$$\text{Overall} \quad 2HCl \longrightarrow H_2 + Cl_2 \tag{3}$$

should be from 15 to 35 wt %. In the electrolysis of aqueous hydrochloric acid, decreasing the length of the diffusion path to 6 microns or less, for the reactant HCl and product $Cl_2$ within the anode, where the electrochemical reaction occurs, helps to minimize the formation of oxygen. Oxygen is formed from the parasitic side reaction of the oxidation of water (eq. 4).

$$\text{Anode } 2H_2O \rightarrow O_2 + 4H^+ + 4e^- \tag{4}$$

A preferred anode catalyst thickness for the electrolysis of aqueous hydrochloric acid is about 2.0 microns to 6.0 microns. The decrease in the thickness in the anode catalyst layer also results in enhancing the protonic conductivity within the catalyst resulting in enhanced electrolysis performance. The performance of thinner electrodes is enhanced by the method of anode fabrication as disclosed hereinabove, which involves use of an ionomer to support the electrocatalytic material. It is important in the present invention to use a solubilized ionomer such as NAFION® as the binder between the electrocatalyst particles as well as in the membrane. The use of an ionomer as binder aids in maintaining an ionic continuity between the catalyst particles within the anode and between the catalyst particles of the anode and the membrane.

The reactor (cell) operates at a potential of 1 to 2 volts (cell voltage) at a current density of 0.1 to 2 amps/cm$^2$ at a temperature of from ambient to 110° C. Increasing temperature results in lower operating potentials (cell voltage) at the same current density. Maximum conversion depends on inlet HCl concentration, which can range from 15 to 35 wt %. Typical outlet concentrations of unreacted HCl are 15 to 17 wt % with less than 0.1 vol % oxygen in the chlorine product at inlet HCl concentrations of 19 to 22 wt %. However, even lower HCl concentrations, i.e., less than 15 wt %, can be achieved.

Typically, the reaction at the cathode is hydrogen evolution from reaction of a solution of protons (eq. 2). In an alternative embodiment, oxygen is added to the cathode in the form of an oxygen-containing gas. The oxygen-containing gas can be, for example, pure oxygen, air, oxygen-enriched air, or combinations of oxygen with nitrogen. Other oxygen-containing gases may also be used. When oxygen is added to the cathode, it is reduced to water (eq. 5).

$$\text{Cathode} \quad O_2 + 4H^+ + 4e^- \longrightarrow 2H_2O \tag{5}$$

In yet another embodiment, a solution comprising a reducible metal ion is added to the cathode. Reducible metal ions include, but are not limited to Fe(III), Cu (II), Ce(IV), Co(III), Au(III), and Ag(II). When a reducible metal ion is added to the cathode, reduction of the metal ion to a lower oxidation state occurs. The cathode reactions for these are provided in equations 6–11. Addition of oxygen or a reducible metal ion to the cathode reduces the $$\text{Cathode} \quad Fe^{3+} + e^- \longrightarrow Fe^{2+} \tag{6}$$

$$\text{Cathode} \quad Cu^{2+} + e^- \longrightarrow Cu^{+} \tag{7}$$

$$\text{Cathode} \quad Ce^{4+} + e^- \longrightarrow Ce^{3+} \tag{8}$$

$$\text{Cathode} \quad Co^{3+} + e^- \longrightarrow Co^{2+} \tag{9}$$

$$\text{Cathode} \quad Au^{3+} + 2e^- \longrightarrow Au^{+} \tag{10}$$

$$\text{Cathode} \quad Ag^{2+} + e^- \longrightarrow Ag^{+} \tag{11}$$

overall cell voltage for evolving chlorine from hydrochloric acid, which lowers process power consumption, thereby reducing operating costs.

Among other advantages, the present invention provides the following advantages over methods known in the prior art:

1. high current density (≧1 amp/cm$^2$) at low cell voltage, and
2. low oxygen evolution at the anode at HCl outlet concentrations as low as 10 wt %.

The present invention is further illustrated by the following examples, but these examples should not be construed as limiting the scope of the invention.

EXAMPLES

EXAMPLE 1

The anodic synthesis of chlorine from aqueous hydrochloric acid was tested in a 5 cm$^2$ proton exchange membrane (PEM) electrochemical flow reactor. The reactor was comprised of a membrane electrode assembly (MEA) and carbon cloth backings. The MEA consisted of a Nafion® 115 membrane with thin film (2 microns) electrocatalyst (electrode) layers deposited onto it. Each electrode consisted of 1.0 mg/cm$^2$ of $RuO_2$. The electrocatalysts had an active area of 5 cm$^2$.

The catalyst deposition process consisted of mixing the electrocatalyst powder, $RuO_2$, and solubilized (liquid) Nafion® (equivalent weight=939) solution in a 6:1 weight ratio of catalyst:solubilized Nafion®, to form an ink. The ink was painted onto both sides of a Nafion® 115 polymer membrane to form the MEA. The solubilized Nafion® solution consisted of 3.5 wt % Nafion® pellets (equivalent weight=939) dissolved in Fluoroinert®, FC-40, a mixture of perfluoro(methyl-di-n-butyl)amine and perfluoro(tri-n-butylamine), available from 3M, St. Paul, Minn. The painted membrane was dried and hot pressed at 130° C., 14 psig for 30 minutes. To form the single cell, the MEA and backings were sandwiched between two graphite blocks into which serpentine flow channels were machined for gas/liquid distribution. Reactants and products entered and exited from the backside of the graphite blocks, diffused through the carbon backings and reacted at the membrane electrocatalyst interface of the MEA.

An aqueous hydrochloric acid solution was fed through the carbon cloth to the anode, concentration provided below in the Table. The acid was delivered to the anode flow channels at a flowrate ranging from 2 cc/min to 12 cc/min. On the cathode side, deionized water was fed at 12 cc/min.

The temperatures of the anolyte, catholyte, and the cell were varied from 60–90° C. The system was operated at atmospheric pressure. At the anode, a flowrate of 12 cc/min of 19% HCl corresponded to 4.8% conversion per pass at a current density of 1 A/cm$^2$. At flowrate of 2 cc/min, conversion was 25%. The chlorine/HCl mixture that exited the cell was sent to a gas/liquid separator. Helium was sent into this separator at 100 cc/min to drive the chlorine gas out of the separator into a scrubbing tank.

TABLE

| Run | Anode Thickness | Acid Conc. | Current Density | Cell Voltage | HCl Conv. |
|---|---|---|---|---|---|
| 1 | 2 microns | 20% | 10 kA/m$^2$ | 1.62 V | 25% |
| 2 | 2 microns | 20% | 8 kA/m$^2$ | 1.61 V | 3.5% |
| 3 | 2 microns | 26% | 10 kA/m$^2$ | 1.61 V | 25% |
| 4 | 2 microns | 26% | 8 kA/m$^2$ | 1.59 V | 3.5% |
| 5 | 2 microns | 19% | 20 kA/m$^2$ | 1.86 V | 25% |

As can be seen from the Table, in this example, a thin, 2 micron anode catalyst layer, that was highly continuous and uniformly distributed across the surface of the membrane, provided in an electrolysis process of aqueous HCl, low cell voltages and high current densities. In all runs, there was less than 0.1 vol % of oxygen in the chlorine product.

EXAMPLE 2

Example 1 was repeated with a 2 micron thick anode, the exception that an aqueous 20 wt % iron (III) chloride solution was fed through a carbon cloth to the cathode, instead of deionized water. The flowrate of the iron (III) chloride solution was 25 cc/min. Hydrochloric acid, 19 wt %, was fed to the anode at a rate of 2 cc/min. The cell temperature was 80° C. The system was operated at atmospheric pressure. Current density was 10 kA/m$^2$ with a cell voltage of 1.22 V. Conversions of HCl and iron (III) were 25%. There was less than 0.1 vol % of oxygen in the chlorine product.

EXAMPLE 3

The anodic synthesis of chlorine from hydrochloric acid was tested in an electrochemical flow reactor wherein the reactor was comprised of a Nafion® 115 membrane and carbon cloth backings. The anode was deposited on the membrane. The cathode was deposited on the carbon cloth on the opposite side of the membrane from the anode.

The anode was prepared in the same manner as described in Example 1 to provide 1 mg/cm$^2$ $RuO_2$ on the membrane. The cathode was a commercially available platinum cathode, 1 mg/cm$^2$ platinum black deposited on carbon cloth.

A 19% hydrochloric acid solution was fed at room temperature through the anode carbon cloth at a flow rate of 2 cc/min. Oxygen was fed through a humidifier to produce humidified oxygen, which was then fed through the carbon cloth backing, upon which was deposited the platinum of the cathode, at a gas temperature of 80° C. The flowrate of gas was 300 sccm. The cell temperature was about 80° C. The cathode portion of the cell was held at 60 psig, while the anode was at atmospheric pressure. Current density was 10 kA/m$^2$ with a cell voltage of 1.20 V. Conversion of HCl was 25%. The oxygen concentration ranged from 0.2–0.3 vol % in the chlorine. It should be noted that the oxygen concentration is primarily due to oxygen diffusing from the cathode to the anode and not due to side reactions of water oxidation at the cathode.

EXAMPLE 4

The anodic synthesis of chlorine from hydrochloric acid was tested in an electrochemical flow reactor wherein the reactor was comprised of a Nafion® 115 membrane and carbon cloth backings upon which were deposited electrocatalyst (electrode) layers for both the anode and the cathode.

A 6:1 $RuO_2$:Nafion® 115 ink was prepared by mixing $RuO_2$ with a 5 wt % suspension of the Nafion® pellets in ethanol with about an equal amount of glycerol added to adjust the viscosity of the ink. The cathode was prepared by painting the ink onto a carbon cloth with a paintbrush. The loading of electrocatalyst was 2.75 mg/cm$^2$ $RuO_2$. The anode was prepared by painting the ink onto a second carbon cloth using a roller. The loading of electrocatalyst for the anode was 0.91 mg/cm$^2$ $RuO_2$. Both the anode and cathode had geometric areas of 5 cm$^2$. The cloths were dried in an air oven at 150° C. for 2 hours. It should be noted that only one side of the carbon cloths was painted and the painted sides were placed facing the polymer membrane to form the reactor.

A 19% hydrochloric acid solution was fed through the anode carbon cloth at a flow rate of 2.2 cc/min. The temperature was about 80° C. Water was fed to the cathode. The reactor was operated continuously for about 50 hours at a conversion of 25% and at a current density of 10 kA/m$^2$. Cell voltage was 1.65 V. Less than 0.1 vol % of oxygen was in the chlorine product. Hydrogen concentration in the product chlorine was typically 0.2–0.5 vol %. Conversely, in Example 1, hydrogen concentration in the chlorine was typically 0.4–0.8 vol %.

EXAMPLE 5

The electrochemical flow reactor of Example 4 was used, having the anode and the cathode deposited on carbon cloth backings. The anode thickness was 2 microns.

A 20% hydrochloric acid solution was fed through the anode at a flow rate of 1.1 cc/min. The temperature was about 80° C. The reactor was run at a conversion of 52%, providing an outlet HCl concentration of about 12% at a current density of 10 kA/m$^2$. Cell voltage was 1.66 V, with less than 0.1 vol % oxygen in the chlorine.

We claim:

1. In a process for the electrolysis of an aqueous solution of hydrochloric acid in an electrochemical flow reactor comprising a solid polymer electrolyte membrane, an anode, and a cathode, to produce chlorine, the improvement comprising feeding the hydrochloric acid solution to an anode comprising an electrocatalytic material and ionomer.

2. The process of claim 1, wherein the reactor is formed by placing the anode on a side of the membrane and cathode on the opposite side of the membrane, the anode and cathode each having a backing.

3. The process of claim 2, wherein the anode is formed by depositing the electrocatalytic material and ionomer onto the membrane.

4. The process of claim 2, wherein the anode is formed by depositing the electrocatalytic material and ionomer onto the backing of the anode.

5. The process of claim 1, 2, 3, or 4, wherein the ionomer comprising the anode is a fluoropolymer having pendant sulfonic acid groups.

6. The process of claim 1, 2, 3, or 4, wherein the electrocatalytic material comprising the anode comprises a catalyst material selected from the group consisting of platinum, ruthenium, osmium, rhenium, rhodium, iridium, palladium, gold, titanium, zirconium, and the oxides, alloys, and mixtures thereof.

7. The process of claim 1, 2, 3, or 4, wherein an oxygen-containing gas is fed to the cathode.

8. The process of claim 1, 2, 3, or 4, wherein a reducible metal ion is fed to the cathode.

9. The process of claim 8, wherein the reducible metal ion is selected from the group consisting of iron (III), copper (II), cerium (IV), cobalt (III), gold (III), and silver (II).

10. The process of claim 9, wherein the reducible metal ion is iron (III).

11. The process of claim 1, 2, 3, or 4, wherein the anode has a thickness of less than 6 microns.

12. The process of claim 1, 2, 3, or 4, wherein the feed hydrochloric acid solution has a concentration of 15 to 35% HCl.

13. The process of claim 1, 2, 3, or 4, wherein a hydrochloric acid solution having a concentration of less than 15% HCl is produced.

* * * * *